US007014077B2

(12) United States Patent
Brown

(10) Patent No.: US 7,014,077 B2
(45) Date of Patent: Mar. 21, 2006

(54) PORTABLE CONTAINER

(75) Inventor: Dennis B. Brown, Logan, UT (US)

(73) Assignee: Nalge Nunc International, Rochester, NY (US)

( * ) Notice: Subject to any disclaimer, the term of this patent is extended or adjusted under 35 U.S.C. 154(b) by 338 days.

(21) Appl. No.: 10/640,880

(22) Filed: Aug. 13, 2003

(65) Prior Publication Data

US 2005/0072804 A1 Apr. 7, 2005

(51) Int. Cl.
*B67D 3/00* (2006.01)

(52) U.S. Cl. ..... 222/543; 220/375; 215/306

(58) Field of Classification Search ..... 222/543; 215/306; 220/375
See application file for complete search history.

(56) References Cited

U.S. PATENT DOCUMENTS

| | | | | |
|---|---|---|---|---|
| 357,272 | A | 2/1887 | Donavin | |
| 469,613 | A | 2/1892 | Vinyard | |
| 1,619,120 | A | 3/1927 | Heaton | |
| 1,637,635 | A | 8/1927 | Corley | |
| 2,013,358 | A | 9/1935 | Osborne | |
| 2,213,057 | A | 8/1940 | Sponsel | |
| 2,412,544 | A | 12/1946 | Waters | |
| 2,500,363 | A | 3/1950 | Koeppel | |
| 2,687,158 | A | 8/1954 | Owen | |
| 2,738,907 | A | 3/1956 | Lacher | |
| 2,828,982 | A | 4/1958 | Kennedy | |
| 3,067,787 | A | 12/1962 | Salk | |
| 3,299,442 | A | 1/1967 | White et al. | |
| D237,018 | S | 9/1975 | Betka | |
| 4,004,614 | A * | 1/1977 | Mackal et al. | 220/375 |
| 4,089,447 | A | 5/1978 | Achmeteli | |
| 4,090,650 | A | 5/1978 | Gotta | |
| 4,193,518 | A | 3/1980 | Holmes | |
| 4,274,566 | A | 6/1981 | Rowe | |
| D263,870 | S | 4/1982 | Greene | |
| D271,805 | S | 12/1983 | Larkin | |
| 4,420,097 | A | 12/1983 | Motsenbocker | |
| 4,526,298 | A | 7/1985 | Boxer et al. | |
| 4,614,267 | A | 9/1986 | Larkin | |
| 4,629,098 | A | 12/1986 | Eger | |
| 4,688,643 | A | 8/1987 | Carter et al. | |
| 4,739,905 | A | 4/1988 | Nelson | |
| 4,739,913 | A | 4/1988 | Moore | |
| 4,758,099 | A | 7/1988 | Branson | |

(Continued)

OTHER PUBLICATIONS

Fastrak Systems, Inc. "Camelbak Profit System", 16 pages, Fastrak Systems, Inc., Weatherford, TX.

(Continued)

*Primary Examiner*—Philippe Derakshani
(74) *Attorney, Agent, or Firm*—Holme Roberts & Owen LLP

(57) ABSTRACT

A container system has a container defining a volume. Inlet structure includes a cap that threads onto a spout. A tether has a first end formed integral with the base or neck of the spout. A second end of the tether is attached to a mount in the cap extending downward so that when installed and in the closed position, the second end of the tether attached to the mount is substantially in the same plane as the first end and the spiral stretch of the tether in between. When the tether moves from the stored position and the deployed position, it urges itself back toward the closed position. The tether has a length for positioning the cap of the inlet structure away from the inlet. A discharge port is connected to a discharge tube and a bite valve.

45 Claims, 10 Drawing Sheets

U.S. PATENT DOCUMENTS

| | | | |
|---|---|---|---|
| 4,848,660 | A | 7/1989 | O'Connell |
| D304,546 | S | 11/1989 | Cattach |
| 4,941,598 | A | 7/1990 | Lambelet, Jr. |
| 5,060,833 | A | 10/1991 | Edison et al. |
| 5,062,591 | A | 11/1991 | Runkel |
| 5,085,349 | A | 2/1992 | Fawcett |
| 5,088,994 | A | 2/1992 | Porat et al. |
| 5,114,059 | A | 5/1992 | Thatcher |
| 5,115,947 | A | 5/1992 | McDonnell |
| 5,125,919 | A | 6/1992 | Miller et al. |
| 5,228,609 | A | 7/1993 | Gregory |
| 5,259,844 | A | 11/1993 | Bilstad et al. |
| 5,282,557 | A | 2/1994 | McCook |
| 5,301,858 | A | 4/1994 | Hollander |
| 5,348,184 | A | 9/1994 | Adams et al. |
| 5,400,934 | A | 3/1995 | Ducros |
| 5,573,135 | A | 11/1996 | Stolzenfeld |
| 5,577,647 | A | 11/1996 | Pittarelli |
| 5,727,714 | A | 3/1998 | Fawcett |
| D396,630 | S | 8/1998 | Lerner |
| D398,776 | S | 9/1998 | Fawcett |
| 5,803,333 | A | 9/1998 | Fawcett |
| 5,806,726 | A | 9/1998 | Ho |
| 5,816,457 | A | 10/1998 | Croft |
| 5,938,081 | A | 8/1999 | Foster |
| 6,003,738 | A | 12/1999 | Foster |
| 6,039,305 | A | 3/2000 | Hoskins |
| 6,070,767 | A | 6/2000 | Gardner et al. |
| 6,247,619 | B1 | 6/2001 | Gill et al. |
| 6,352,235 | B1 | 3/2002 | Cizek |
| 6,675,998 | B1 * | 1/2004 | Forsman et al. ..... 220/375 |

OTHER PUBLICATIONS

Fastrak Systems, Inc., Camelbak advertisements, 15 pages, Fastrak Systems, Inc., Weatherford, TX.

* cited by examiner

PORTABLE CONTAINER

BACKGROUND OF THE INVENTION

1. Field

This invention relates to portable containers for liquids and other material and more particularly to containers with flexible side walls and at least one spout and at least one discharge port with the spout having a cap and a tether to retain the cap relative to the spout.

2. State of the Art

There has been increased awareness of the need to take fluids into the body and in particular water. Typically, one would normally simply drink, for example, a glass of water from a convenient source of potable water to take in fluid. Many, if not most municipalities supply potable water to households and other buildings within its limits. Others may have a water well. Of course, there are also a wide variety of water dispensing bottles, water filters, water coolers, and the like for providing drinking water upon demand.

A glass or cup is suitable if not preferred to transfer water directly to the user; but such a vessel may not be the most suitable for that purpose in a wide variety of active situations. In turn, hydration systems have been developed for use in variety of active applications including, for example, during cycling, hiking, jogging, walking, or any other physical exercise or work that leads to a loss of body liquids.

Hydration systems may also be used in situations where an open container like a glass or cup is susceptible to spillage. For example, while driving in a vehicle like an automobile or truck, the driver or passenger is more likely to spill from a cup or glass as the vehicle encounters road irregularities or is otherwise maneuvered to cause some spillage from the glass, cup or the like.

Water containers such as canteens, canvas water bags, goat skins and bota bags have long been in use to allow users to carry or transport liquids such as water. More recently bottled water has become increasingly available in a variety of different sized containers (e.g., liter, half liter and even smaller sizes). Some bottled water containers have open-close or spout valves (sometimes called sport bottles) as part of their cap or closure system so that a user may open to drink and close for transport while walking, hiking, riding, shopping, jogging, gardening, or any other activity that exposes an open container (like a cup or glass) to destabilization and spilling of the liquid contents. Typical spout valves are slide valves having a slide that moves relative to a stem to mask and unmask water port(s). A slide valve may be operated by the hands/fingers; but it may also be seen being operated by biting gently on the slide valve which pulling on the bottle to cause relative motion between the slide and the stem.

In active environments like hiking, jogging, biking, and other forms of physical outdoor exercise as well as working hard in a hot environment or in hot weather, the body's need or demand for water may be quite high. At the same time, the user is active and less inclined to divert attention to drinking from a container. Also the user's hands may be occupied or in use. In turn, hydration systems are known in which a tube is interconnected to a reservoir of fluid at one end and in which a bite valve is positioned on the other. The user may then place the bite valve in his or her mouth and by biting with the jaws/teeth, operate a valve between an open position or a closed position. In the open position, fluid may be taken in the user's mouth from the connected container or reservoir because the fluid is placed under pressure or because the user creates a vacuum by sucking with the bite valve open. Of course, as soon as the user releases the bite valve, the valve closes and the fluid flow is terminated.

Camelback Products, Inc. of 1310 Redwood Highway, Petaluma, Calif., 94954 which offers the PEAK BAGGER and RIM RUNNER portable hydration products which include a reservoir, an interconnecting tube and a bite valve. TFO, a division of Nalgae Nunc International, Inc. of Logan, Utah offers hydration systems such as the KALIHARI COMBO (model number 01146-015) which include a reservoir, an interconnecting tube and a bite valve. See also, U.S. Pat. No. 6,039,305 (Hopkins, et al.) which discloses a hydration bladder coupled by a tube to a bite valve.

Existing or known hydration systems do not provide for easy access to incorporate solid material, have a cap or closure that can easily become disassociated and are not easily held.

SUMMARY OF THE INVENTION

A container has wall means for defining a volume to contain matter. A mouth is positioned in the wall means for passing matter into and out of the volume. A cap is sized to fit on the mouth and positionable between a closed position in which the cap is positioned on the mouth to inhibit the movement of the matter into and out of the volume and an open position in which said cap is removed from the mouth for the movement of matter into and out of the mouth.

A tether has a first end and second end with a stretch therein between. The first end of the tether is secured to one of the wall means or the mouth. The second end of the tether is secured to the cap. The tether is movable between a stored position in which the tether is positioned substantially within the mouth and a deployed position in which the tether extends from one of the mouth and the wall means to the cap in its open position. That is, the tether is within the mouth and may extend into or be in the volume. The stretch is formed to be in a selected geometric shape and thus maybe triangular, rectangular or the like in shape. Preferably it is spiral in shape when in the stored condition. It is also formed of a material having a memory urging the stretch from the deployed position toward the stored position.

The mouth or inlet assembly preferably has a base attached to the wall means. A neck is attached to the base and extends away from the base and away from the wall means to receive the cap. There is preferably an attachment means for removably and sealably associating the cap with mouth such as the neck when the cap is positioned in its closed position. In one form, the attachment means includes first threads formed on the neck and second threads formed on or in the cap for engaging the first threads. Alternate arrangements may include snap fits, friction fits or any other suitable arrangement to secure a cap to a spout.

The first end of the tether is preferably formed unitarily with the mouth which desirably has a rim that is substantially planar and defines a rim plane. The cap preferably has a mount to which the tether is attached. The mount is preferably attached to the interior surface of the cap. The mount in preferred assemblies extends from the cap (in the closed position ) to or proximate the rim plane. The stretch has a length selected so that when the tether is in its stored position, it extends spirally at least 360 degrees and more preferably abut 540 degrees about the mount.

The tether desirably has an effective length sized for positioning the cap away from the mouth a distance selected for user access to the mouth to drink therefrom or to add or subtract solids from the interior. The mount is more preferably a post with a rivet having a head attaching the tether to the post. The second end of the tether has an aperture sized to receive the rivet there through to rotate there about. Even more preferably, the tether has a thickness and a width at least twice that of the thickness. The tether is preferably mad of flexible plastic and in turn has a memory to return to its flat spiral shape in the stored or at rest. Preferably the plastic is polyethylene or polyethylene.

In some desired arrangements, the wall means is unitarily formed to have a bottom, at least one wall and a top configured to define the mouth. A sport bottle is typically of this type.

In other desired configurations, the wall means is formed of a least one flexible sidewall having an upper edge sealed to form a first seal and a lower edge sealed to form a second seal. A discharge port is desirable sealed into said second seal. The discharge port is preferably a boat shaped structure having opposite sides with the neck or aperture extending there up between the opposite sides. The sides are ribbed for contact with the wall at the lower seal.

In a preferred configuration, a discharge tube is connected to the discharge port. A bite valve is attached to the distal end of the discharge tube. In a preferred and alternate assembly, the discharge port includes a valve operable between an open position and a closed position. The valve may be a bayonet valve with the discharge tube having a bayoneted connector for insertion into said valve to operate the bayonet valve between a normally closed position to an open position. In a preferred configuration, the bayonet valve has an axis essentially normal to said lower seal. The bayonet valve includes an elbow extending away from the axis. In alternate configurations a connector may be fixedly or rotatably secured to the aperture in the base.

In yet another configuration, the container further includes a thermal control chamber positioned proximate the wall means and attached thereto. The thermal control chamber includes a substance that may be thermally treated to place it at a temperature different from ambient temperature. The thermal control chamber is preferably at least two separate sealed chambers.

In a more preferred arrangement, the container includes a handle fixed to the mouth for grasping by the user and to support the container. The handle preferably includes apertures sized and shaped for positioning on suspension structure for suspending or hanging the container for storage and for use to provide for gravity flow.

DESCRIPTION OF THE DRAWINGS

In the drawings, which are presently regarded as preferred embodiments of the inventions and the content of which drawings are incorporated into and made a part of this specification.

DESCRIPTION OF THE ILLUSTRATED EMBODIMENTS

Figure 1:
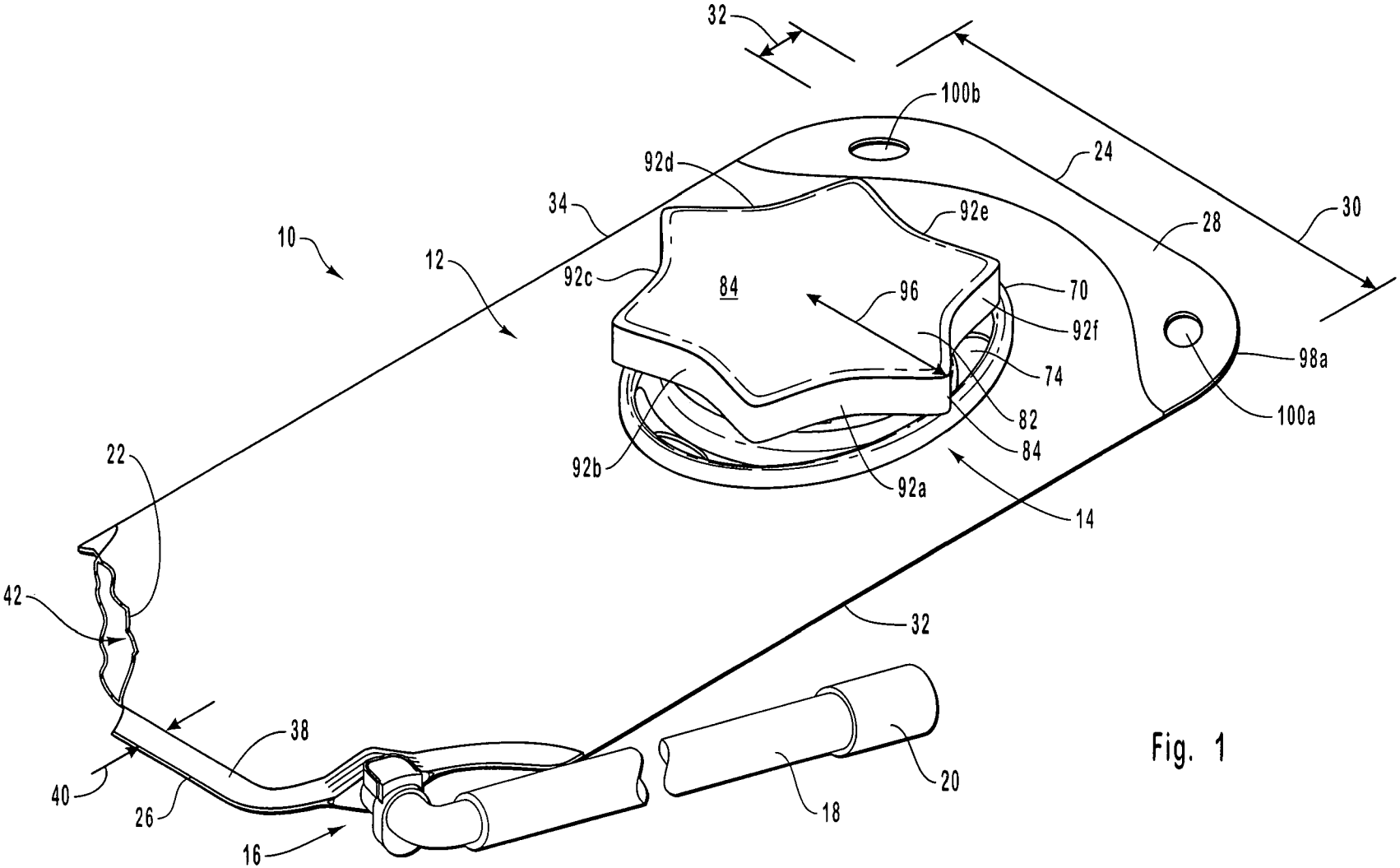
FIG. 1 is perspective of a container system of the present invention.

A container system 10 includes a container 12 having at least one inlet assembly 14, a discharge port 16, a discharge tube 18 and a bite valve 20. The container system 10 is sized to be carried by a user in any convenient manner. In one known arrangement, the container system is positioned in a back pack which a user can carry on the user's back with straps over the user's shoulders. Alternately, the container system 10 may be suspended around the user's waist by a belt or carried in a purse-like arrangement having a supporting strap over one shoulder. Any suitable arrangement can be used to transport the container system 10 on the person of a user or on some other structure suitably available to a user when desired. The container of the container system may be made of a soft plastic materia, of a rubber-like material or a semi-rigid material like existing sport bottles or PTFE bottles presently used to contain water, sport drinks, and the like. When the container 12 of the invention is made of a semi-rigid plastic like a sport bottle, it has an inlet assembly comparable to the inlet assemblies 14 or 102 positioned on the top or at one end in lieu of the other spouts or caps provided in present structures.

Figure 3:
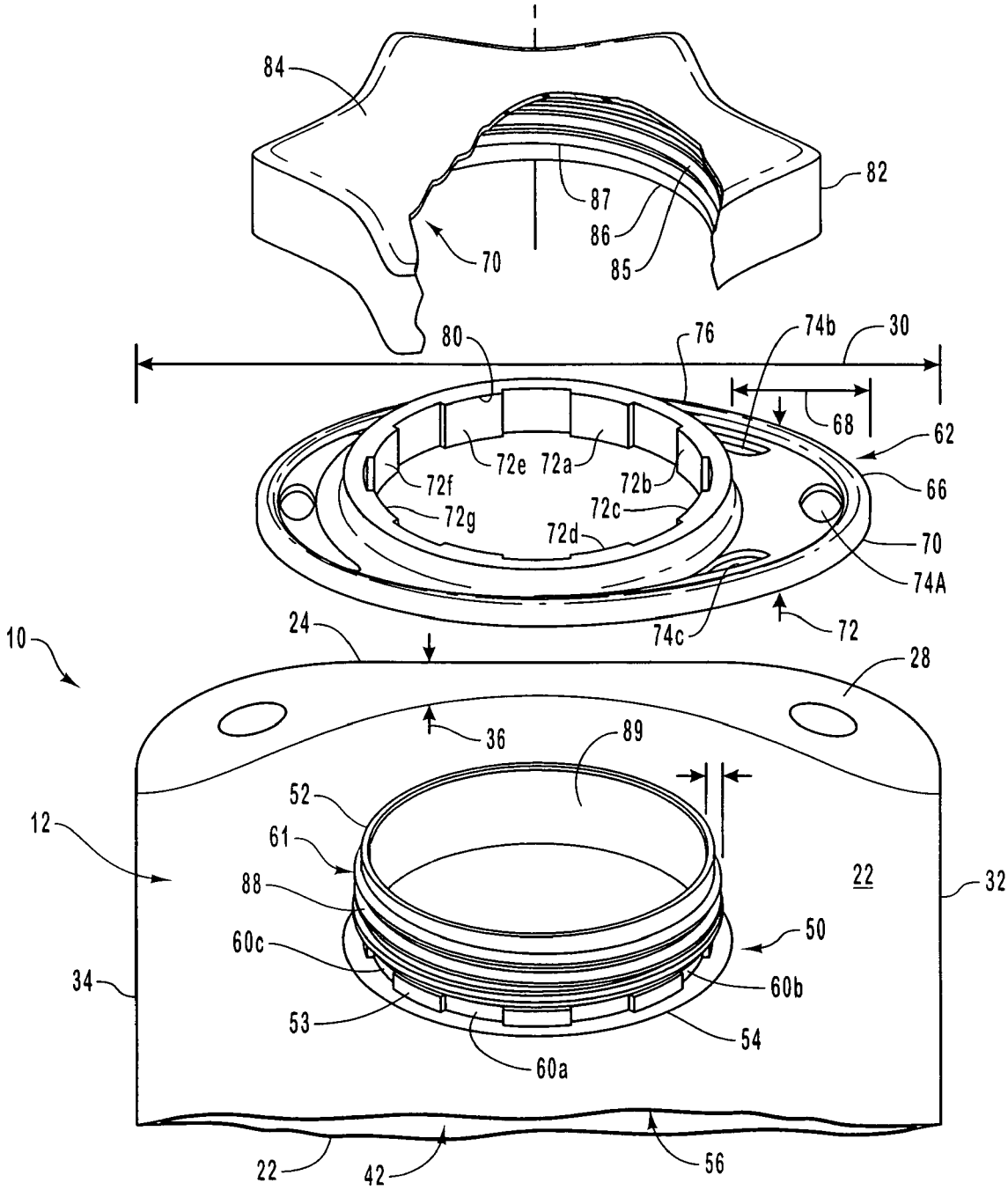
FIG. 3 is a partial perspective exploded view of the container system of FIG. 1.

The presently preferred container 12 shown in FIGS. 1 and 3 has side wall means which is shown to be a single flexible plastic wall 22 that is here shown to a tube or sleeve with opposite ends. The wall 22 may be formed by any suitable means to have an upper edge 24 at one end and a lower edge 26 at the other end. The wall 22 is folded or flattened to form an upper edge 24 and in turn a right edge 32 and a left edge 34. The upper edge 24 is then joined or sealed by any suitable means. For example, one could use one or more mechanical clamps on the upper edge 24 or over a folded upper edge 24. In the arrangement of FIGS. 1 and 3, glue may also be used but plastic welding is preferred. When the upper edge 24 is joined or sealed, a first seal 28 along the upper edge 24 is formed.

The first seal 28 extends along the full width 30 of the container 12 and has a thickness 36 along the width 30 which thickness 36 may vary. The thickness 36 is selected to not separate when the seal 28 is under or experiencing the pressure from liquids within the container 12 as hereinafter discussed.

The lower edge 26 is also pressed to form the right edge 32 and left edge 34. The lower edge 26 is thus clamped, welded, glued or otherwise attached like the upper edge 24 to form the second seal 38 which also extends the width 30 of the container 12. The second seal 38 also has a thickness 40 similar to thickness 36.

Upon formation of the first seal 28 and the second seal 38, a volume 42 is defined which is liquid resistant and intended to contain a liquid which a user wants to transport. The container 12 is preferably formed of a liquid resistant material while being flexible and suitable to deform over and around the use's body or a support structure.

The volume 42 of the container 12 is typically selected to provide the user with a desired or suitable quantity of a desired liquid. Sizes may vary from 0.5 liter to several liters. The wall 22 of the container 12 here shown in FIGS. 1 and 3 is made of a durable thick plastic that may be as much as 0.5 mm to reliably contain the desired liquid while the user is walking, jogging or the like. That is, the wall is selected of a material that resists punctures. The wall 22 of the container 12 is of sufficient thickness to sustain deforming forces imparted while performing exhaustive physical exercise. That is, the liquid in the volume 42 can exert Newtonian forces to the container 12 as the container 12 is moved rapidly or radically. At the same time, the container 12 can be forced against surrounding structures in turn imparting substantial stress to the container 12 and more specifically to the wall 22 and the first seal 28 and the second seal 38. Low density polyethylene of the specified thickness has been found to be one suitable material for the wall 22 that withstands the forces identified.

The inlet assembly 14 of FIG. 1 is better seen in FIG. 3 with a base 50 which is here circular in shape with a neck 52 extending upward from the base through an aperture 54 formed in the wall 22 which aperture 54 functions as a mouth for the movement or passage of material into or out of the volume 42. The base 50 is preferably mounted on the interior 56 of the wall 22 and is secured thereto by glue, welding or the like to effect a liquid tight seal thereabout. Of course, a mechanical seal can be effected by snugly fitting the aperture 54 about the neck 52 which is not here shown.

The neck 52 has a thickness 56 sufficient for the formation of indentations about the perimeter 61 such as indentations 60A, 60B and 60C. A handle 62 has a locking ring portion 64 and a lever arm portion 66. The lever arm portion 66 has a length 68 selected to be sufficient for a user to grasp the lever arm portion 66 between thumb and at least the forefinger. The lever arm portion 66 has a width selected to accommodate the thumb and forefinger and other fingers if the weight of the container 12 with liquid therein so requires. The lever arm portion 66 is here shown to be tapered from the ring portion 64 toward a tip 70. It is shown to be somewhat elliptical in shape with an effective thickness 72 selected to easily accept fingers of an adult for grasping. For example, the effective thickness 72 could be from about 1.5 inches to about 2.5 inches for a container 12 sized to hold a liter.

The lever arm portion 66 is shown with several stiffening apertures 74A, 74B and 74C. While the apertures 74A–C strengthen the lever arm portion 66, they also reduce the weight nominally and allow for the use of less material thereby reducing cost. The apertures 74A–C also function as receptacles for hooks or the like so that the container system 10 and more specifically the container 12 can be suspended from a hook, peg, nail, branch, or the like by placing one of the apertures 74A–C thereover. The lever arm portion 66 also has a rim 76 that extends thereabout and around the locking ring portion 64 to facilitate grasping and holding by the user and to strengthen the handle 62 to support it when suspended from a hook or the like.

The locking ring portion 64 has a plurality of teeth such as teeth 78A–G disposed about the interior 80 of the locking ring portion 64. The teeth 74A–G are sized and spaced to snap fit into corresponding indentations 60A–C spaced about the neck 52. When installed as seen in FIG. 1, the handle 62 is snapped into the indentations about the bottom 53 of the neck 52 like indentations 60A–C. In turn, the handle 62 snugly holds the wall 22 against the base 50 or between the base 50 and the handle 62. The handle 62 also acts as a handle or graspable extension so that a user may pick up and move the container 12.

It should be understood that the handle 62 can be threaded onto the neck 52 or even glued to the neck 52 to effect a solid or rigid connection thereto. In fact, any mechanical association that fixes the handle to the neck 52 or the base 50 may be used as desired.

As better seen in FIG. 3, a cap 82 is shown with a cut away portion to better see that it has a solid upper surface 84 and a circular throat 86 with threads 87 on the interior surface 85 sized to engage with threads 88 on the neck 52 and effect a water resistant seal between the neck 52 and the cap 82. Alternately, the threads of the throat 86 could be formed on the outer surface of the throat 86 to interact with threads formed on the interior surface 89 of the neck 52. The interior 90 of the cap 82 may have a gasket to assist in effecting the water resistant seal. The cap 82 is shown with a plurality of scallops 92A–F to facilitate grasping and rotation by a user. That is, the scallops 92A–F form points 94 which have a lever arm 96 against which the user may press his or her fingers to facilitate rotation of the cap 82 by the user. Of course, the scallops 92A–F also facilitate use with wet or slippery hands.

While the cap 82 is shown being connectable to the neck 52 by threads, other arrangements including friction fit, snap fit, press fit, and the like may be selected by the user. The threaded positive connection is preferred, but users in some cases may prefer alternate arrangements to control cost or facilitate removal and closure.

Returning to FIG. 1, it can bee seen that the container 12 is somewhat rectangular in projection with a discharge port 16 positioned in and formed into the second seal 38 along the lower edge 26. The discharge port 16 is discussed in more detail hereinafter. A discharge tube 18 which may be any suitable tube like surgical tubing or Tygon™ tubing. The discharge tube 18 is connected to the discharge port 16 to transport the liquid from the volume 42 to a bite valve 20. A bite valve 20 is sized to position in the mouth and function so that as a user bites thereon, it moves from a closed position toward an open position. The user can thereby press on the container 12 to urge fluid through the discharge tube 18 and bite valve 20 into the user's mouth. Alternately or simultaneously, the user can suck to create a vacuum and suck the liquid out of the container 12. Any suitable bite valve can be used.

At the corners 98A and 98B of the container 12 along the upper edge 24, there are two apertures 100A and 100B. The user may use the apertures 100A and 100B to fasten the container 12 to a transportation device or to suspend it from one or more hooks, pegs or the like.

Figure 2:
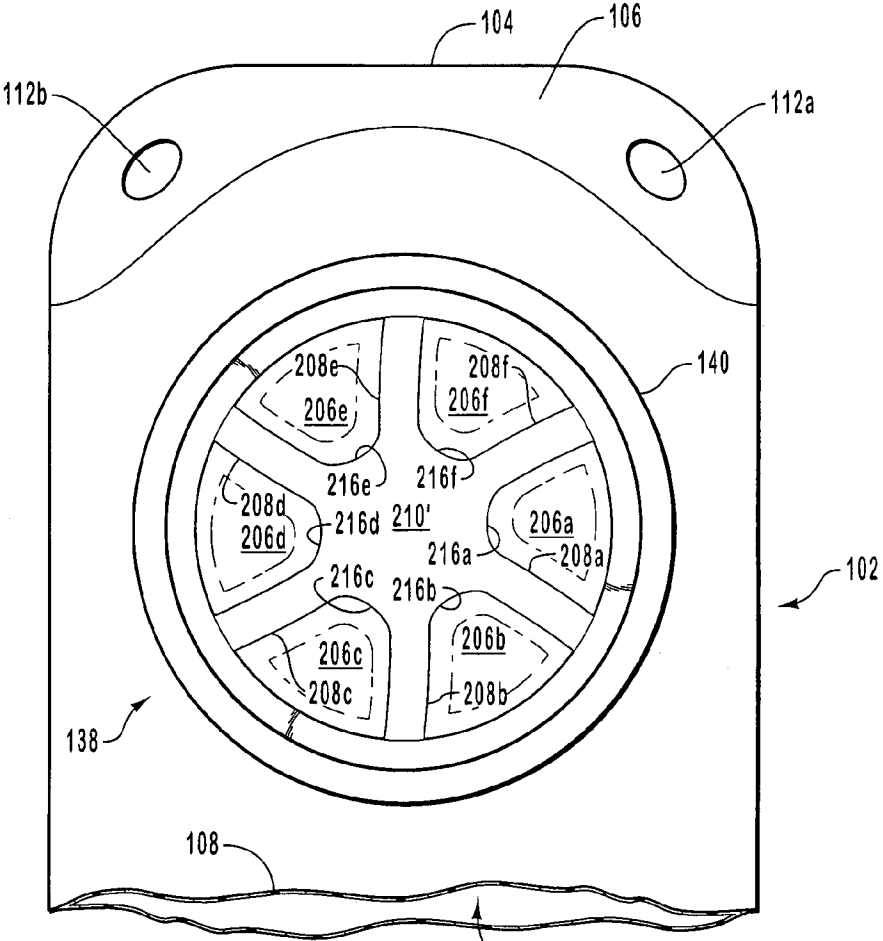
FIG. 2 is partial frontal planar view of an alternate arrangement of the present invention.
Figure 4:
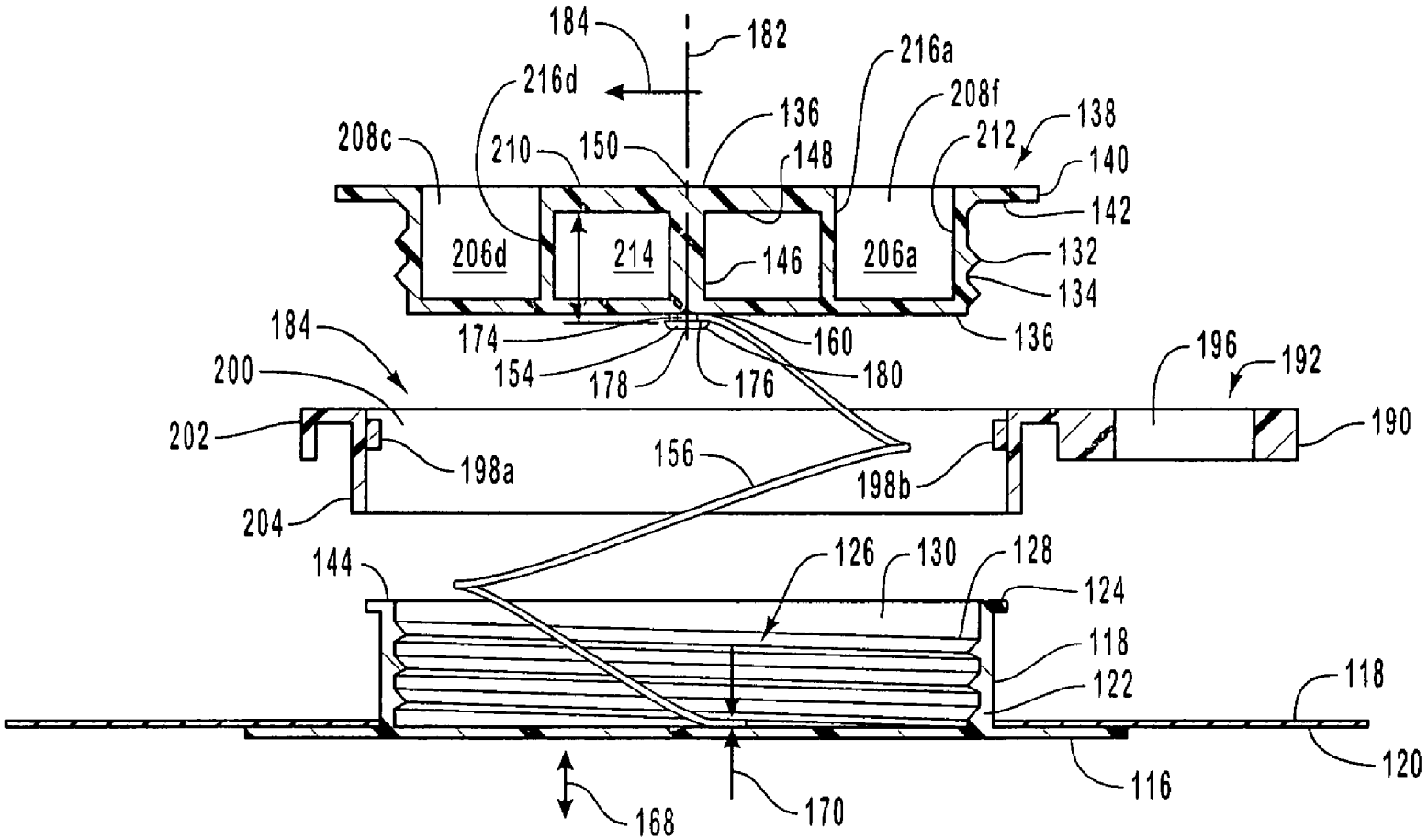
FIG. 4 is a cross sectional view of another arrangement of the present invention.
Figure 5:
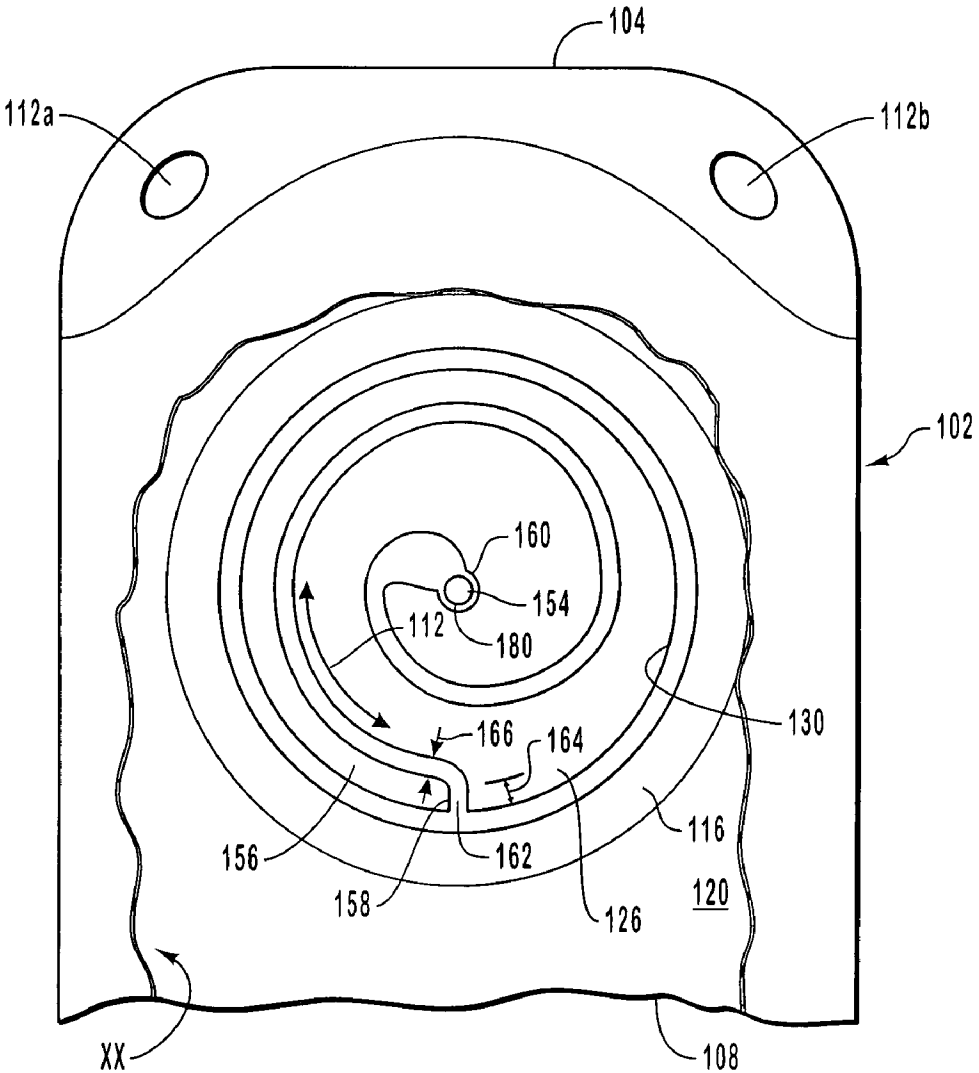
FIG. 5 is a rear planar view of the arrangement of FIG. 4.

Turning now to FIGS. 2, 4 and 5, a container 102 is formed from a tubular material which is sealed at the upper edge 104 to form a first seal 106. The container is formed to have a wall 108 which defines a volume 108 to contain a liquid to be transported. The first seal 106 has a height sufficient to form eyelets 112A and 112B. The eyelets 112A and 112B allow a user to to secure the bag in a transportation device or suspend it from hooks, pegs, nails, branches, or the like. Being formed in the seal portion, the eyelets 112A and 112B are believed to be stronger and more structurally rigid to be able to support more weight without deformation of the wall 108.

An inlet assembly 114 is provided to allow liquids to pass into and out of the volume 110 of the container 102. The inlet assembly 114 is here shown to have a base 116 with a neck 118 extending from the base 116. The base 116 is shown attached to the interior surface 120 of wall 108. The neck 118 has a smooth outer surface 122 with a lip 124 formed to extend about the opening 126. Threads 128 are formed on the inner surface 130 of the neck 118 to receive the threads 132 formed on the outer surface 134 of the insert 136 of cap 138.

The cap 138 has a rim 140 that has an under surface 142 which frictionally engages the upper surface 144 of the lip 124 when the cap 138 is secured tightly in place. The cap also has a post 146 that extends downward or away from the under surface 148 of the cap 138 at or proximate the center or midpoint 150 thereof. The post 146 has a length 152 sized to position the rivet 154 at or just below the base 116 when the cap 138 is fully secured in the neck 118.

As best seen in FIGS. 4 and 5, a tether 156 is secured to the neck 118 by any suitable means including glue, welding, clamps, screws or the like. Preferably, the tether 156 is unitarily formed with the neck 118 to extend into the opening 126 of the neck 118. That is, the tether 156 has a first end 158 unitarily formed with the neck 118 and a second end 160 secured to the post 146. The first end 158 of the tether 156 has a leg portion 162 to extend away from the inner surface 130 of the neck 118 a distance 164 about the same as the width 166 of the tether 156. The leg portion 162 is provided to provide the tether 156 with a portion to generally bend axially 168 relative to the neck 118 so that the tether 156 will flex and not inelastically deform or break when it is repeatedly flexed.

The tether 156 has a width 166 that is at least twice its thickness 170 and preferably about 4–6 times its thickness 170. The tether 156 has an effective length 172 and extends in any desired or selected geometric pattern about the post 146 from the leg portion 162 to the second end 160 from the base at least once and in the illustration about 1.5 times or about 540 degrees. Preferably, the desired or selected geometric pattern can be likened to a spiral. That is, the tether 156 winds from the neck 118 with a decreasing radius or a locus that follows a track of decreasing radii about the point which is the rivet head 180. The locus or path of the tether could yield any other desired shape in the stored position so that it would appear to be triangular, rectangular, hexagonal, or the like, so long as there is a decreasing distance from the center point for the tether along its length from the post 146 to the neck 118. The second end 160 has an aperture 176 formed therein through which the shaft 174 of rivet 154 is positioned as the rivet shaft 174 is advanced into the post 146. The underside 178 of the rivet head 180 acts as a bearing surface about which the second end 160 of the tether 146 rotates as the cap 138 is threaded into or out of the neck 118.

When the cap 138 is removed from the neck 118, the tether 156 deforms or bends so that the cap 138 may be displaced from over the opening 126 so that the user can insert or remove liquids or other matter through the opening 126. The tether 156 can be said to behave somewhat like a soft coil spring in that it can be moved from a stored position as seen in FIG. 5 to one of a plurality of extended positions one of which is seen in FIG. 4. That is, the tether 156 can deform axially 168 as well as transverse 184 to the axis 182 so that the cap 138 can be removed and displaced from over the opening 126. The effective length 172 is selected so the cap is spaced away from the opening 126 but yet is not free to contact other surfaces and become contaminated such as by contact with dirt or an unwashed hand.

With the tether 156 distended or deformed, it has a spring or elastic characteristic that urges it toward the at rest or stored position seen in FIG. 5. That is, the tether 156 is made of a plastic or plastic-like material which is also preferably a low density polyethylene. When it is distended or deformed from an the rest position, it has a tendency to return to its at rest position. Thus, the cap 138 can be threaded into the neck 118 to a sealed or closed position and the tether 156 returns to a stored or at rest position as seen in FIG. 5. In the stored or at rest position, the tether 156 is substantially in a plane that is proximate and is preferably in the plane defined by the flat base 116. Thus, the tether 156 does not preferably extend into the volume 110. In some applications, the tether 156 may extend below the base 116 in whole or in part. The length 172 of the tether 156 may also be selected to be longer or shorter based on the size of the opening 126 and the cap 138.

FIG. 4 also illustrates a handle 190 comparable to handle 62 in FIG. 3. The handle 190 has a lever arm portion 192 unitarily formed with a locking portion 194. The lever arm portion 192 is ovular in projection with at least one aperture 196 formed for supporting the handle 190 and in turn the container 102 on a suitable support like a nail, peg, or hook. The lever arm portion 192 is sized for grasping by the user by at least the thumb and forefinger so the user can lift and carry the container 102 out of a transport device or otherwise.

The locking portion 194 of the handle 190 is shown in section with two snaps 198A and 198B formed on the interior surface 200. The handle 190 is sufficiently elastic that it can bend and distort so that a user can press it down onto the neck 118 so that the snaps 198A and 198B snap over and engage the lip 124. When positioned over the lip 124, the handle 194 is securely in place and snugly pressing the wall 108 against the base 116.

The handle 190 also has a stiffener ring 202 around the periphery 204 of the locking portion 194. The stiffener ring 202 provides the locking portion 194 and in turn the handle 190 with the structural strength necessary to support the weight of the container 102 when the container 102 is picked up by the handle 190 and the container 102 filled with a liquid like water.

The cap 138 is shown in FIG. 2 without the associated handle 190. The cap 138 has a plurality of recesses 206A–F with ribs 208A–F extending from a middle section 210 to the outer wall 212. An inner cavity 214 is formed under the middle section 210 from the inner walls 216A–F. The post 146 is attached to the middle section 210 and extends downward through the inner cavity 214.

Figure 7:
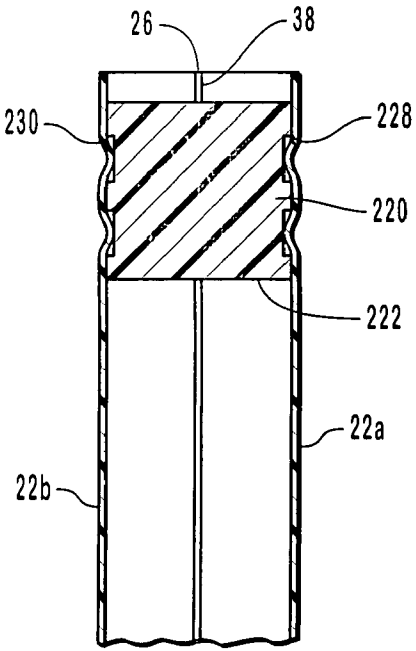
FIG. 7 is a cross sectional view of the discharge port of FIG. 6 on the section lines 7—7.
Figure 6:
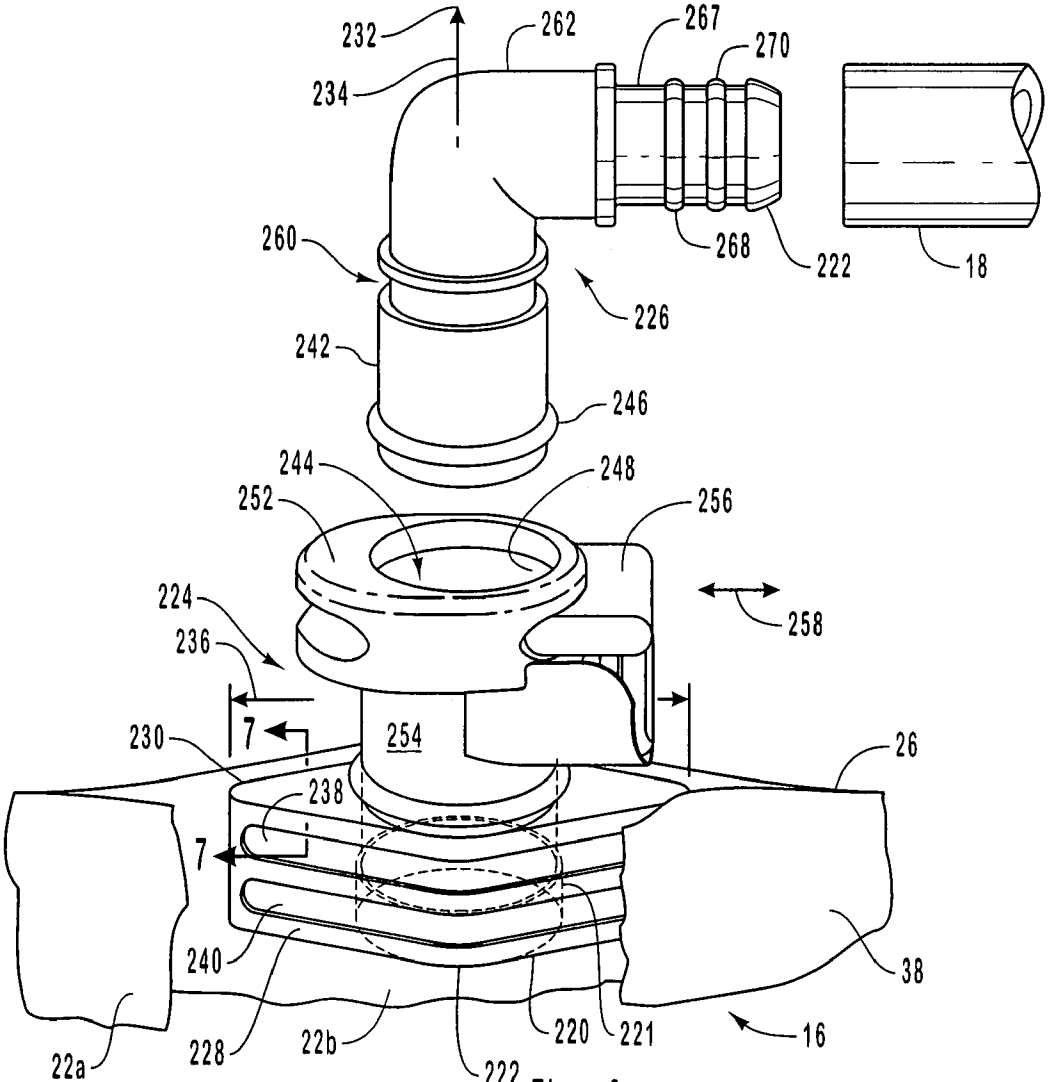
FIG. 6 is a perspective view of a discharge port of the container system of FIG. 1.

Turning now to FIGS. 6 and 7, a discharge port 16 is shown installed in the second seal 38 along the lower edge 26 of the container 12. The second seal 38 is formed by glueing or welding the opposite sides 22A and 22B of wall 22 about the base 220 of the discharge port 16. The base 16 has an aperture 221 (shown in dotted line) extending from the bottom surface 222 upwardly in communication with a discharge valve 224 for the passage of liquid from the volume 42 through the discharge valve 224 to the connector 226 and then to the discharge tube 18. In alternate arrangements, a moveable elbow comparable to elbow 266 (FIGS. 8–10 may be inserted into aperture 221 to swivel therein. Of course an elbow may also be fixedly secured in the aperture 221 of the base if desired.

The base 220 is here shown to have opposite arcuate sides 228 and 230 that may be ovular or circular with a radius having a center 232 at a distance or radius 234 equal to at least the length 236 of the base 220. The opposite arcuate sides 228 and 230 each have at least two raised ribs 238 and 240. Heat sealing or welding causes the wall 22 to inelastically deform about the ribs 238 and 240 creating a seal of sufficient strength to be liquid resistant.

The valve 224 is here shown to be a bayonet valve in which a sealing gate is operable between a closed position and an open position when the bayonet 242 is inserted into the valve mouth 244 in a conventional fashion. The bayonet 242 has an "o" ring 246 to effect a seal against the interior surface 248 of the mouth 244 with a shoulder 250 provided to abut the upper surface 252 of the valve body 254. A movable lock 256 moves away 258 from the valve body 254 for the bayonet 242 to be inserted into the mouth 244. Once the bayonet 242 is installed securely, the lock 256 is urged toward 258 the bayonet 242 to register with the channel 260 in the bayonet 242. The bayonet 242 is connected to an elbow 262 which is hollow with a channel formed therein. The elbow 262 is either unitarily formed with the bayonet 242 or to receive the connector 264 of a separate elbow 266 of FIGS. 8, 9 and 10.

The elbow 262 of FIG. 6 has an outlet connector 267*a* plurality of ridges 268, 270 and 272 over which the discharge tube 18 is positioned. The ridges 268 and 270 distort or distend the discharge tube 18 as it is installed over the ridges 268, 270 and 272.

It may be noted that the discharge port 16 is here shown in the second seal 38 along the lower edge 26. The discharge port 16 may be oriented with the discharge port located elsewhere in the container 22.

Figure 8:
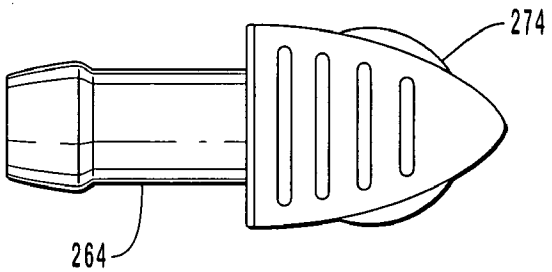
FIGS. 8–10 are views of portions of the discharge port of FIGS. 6 and 7.
Figure 9:
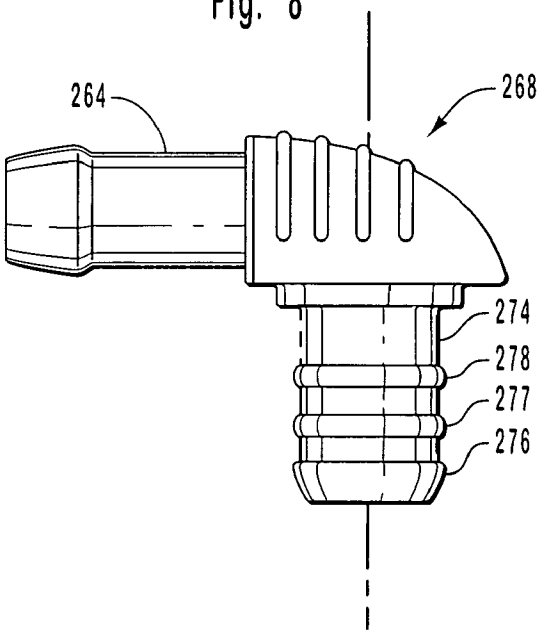
Figure 10:
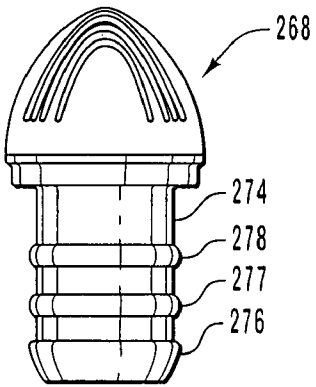

FIGS. 8, 9 and 10 show an elbow 266 suitable for installation and use at the discharge port of or from the container 12. As stated herein before, the connector 264 may be sized to connect to the discharge valve 18. A second connector 274 having sealing surfaces 276, 277 and 278 is sized for removable insertion into an aperture in a base like aperture 221 in base 220. The sealing surface may be "o" rings or raised surfaces sized to effect a water or liquid resistant seal when inserted into an aperture in a base. When inserted the elbow 266 may then be rotated or swivelled about axis 267.

Figure 12:
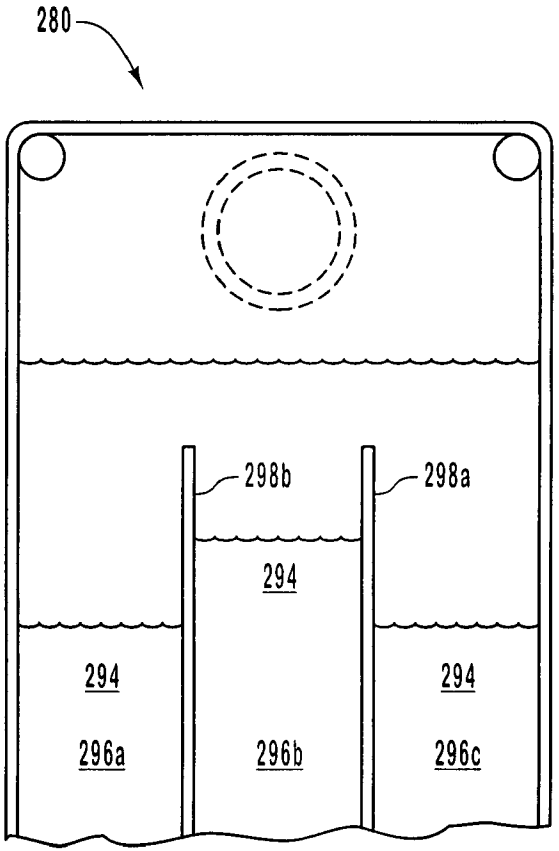
FIG. 12 is a rear view of the alternate embodiment of FIG. 11.
Figure 11:
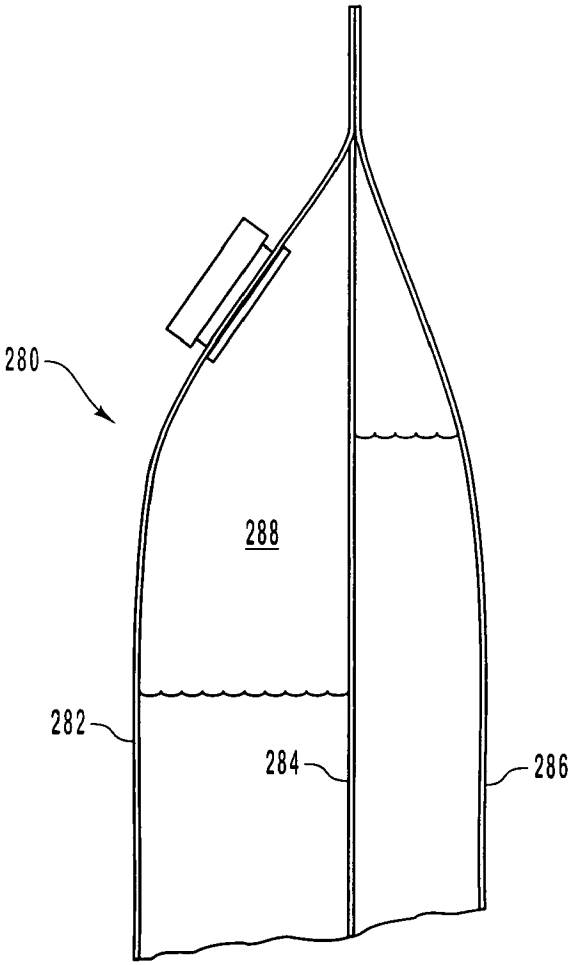
FIG. 11 is a side view of an alternate embodiment of the present invention.

FIGS. 11 and 12 show a container 280 having a first wall 282, a second wall 284 and a third wall 286. The first wall 282 and the second wall 284 define a first volume 288 much the same as volume 42 of container 12. The container 280 of FIGS. 11 and 12 has a second volume 290 defined by the second wall 284 and the third wall 286. The container 280 has an inlet assembly 292 so that liquids and materials may be placed into the first volume 288. A discharge port to discharge liquids from the first volume 288 may also be provided comparable to discharge port 16 in FIG. 1.

The second volume 290 is here shown to contain a thermal liquid 294 which is inserted before the second volume is formed by sealing all of its respective edges. The second volume is here shown formed into three separate chambers 296A, 296B and 296C that may be separate or may be communication with each other over separate side seals 298A and 298B. The thermal liquid 294 is one that may be heated or frozen to thereby allow for heat transfer from the second volume 290 to the liquids and materials in the first volume 288 or to allow for heat transfer from the liquids and materials in the first volume 288 to the frozen or cooled thermal liquid 294 in the second volume 290 and in turn cool the liquids and materials in the first volume 288.

An alternate mouth or inlet assembly 300 has a base 302 with a neck 304 extending upwardly therefrom. The neck 304 has threads 306 formed about the exterior surface 308 to threadedly engage with threads 310 formed on the interior surface 312 of cap 314. The upper surface 316 of the neck 304 has as beveled portion 318 which frictionally and sealingly mates with a sealing surface 320 extending from the under surface 322 of the cap 314. With the cap 314 snugly secured to the neck 304, the upper surface 316 extends toward the undersurface 322 and thereby forms a seal cavity 324. The seal cavity 324 is sized to receive the upper surface 316 as the sealing surface 320 wears.

The neck 304 also has a flange 326 disposed proximate but above the base 302 a distance sufficient to receive the wall 328 and a handle 330 with a locking ring 332 and sealingly retain the wall 328 against the base 302.

The cap 314 has a post or mount 332 extending downward from the inside surface 322. The post 332 is here shown to be hollow and substantially cylindrical in shape. While the post 332 is here shown to be cylindrical in shape, it may be in any suitable or desired geometric configuration so long as it extends the necessary distance from the inner surface of the cap and provides for the attachment of the rivet. The rivet 334is here shown with a plurality of circular teeth 338 disposed along the length 340 to frictionally engage the interior surface 342 of the hollow post 332. Alternately, the rivet 334 may be hollow with teeth or threads to engage the outer surface of the post. A friction fit may also be suitable particularly if tapered surfaces are used to allow for wear over time. The rivet 334 has a collar 344 which may have a beveled surface 346 to abut the outer surface 346 of the post 332. The rivet 334 may thereby be removed from the post 332 to facilitate cleaning when desired. In lieu of the circular teeth 338, a thread may be employed. Alternate arrangements may be suitable so long as the rivet 334 is readily removable and reinstallable.

The cap 314 is here shown with a plurality of indentations 350 formed to receive the user's fingers to facilitate engagement by the fingers for application of rotational forces to effect installation and removal of the cap 314 from the neck 304.

Figure 13:
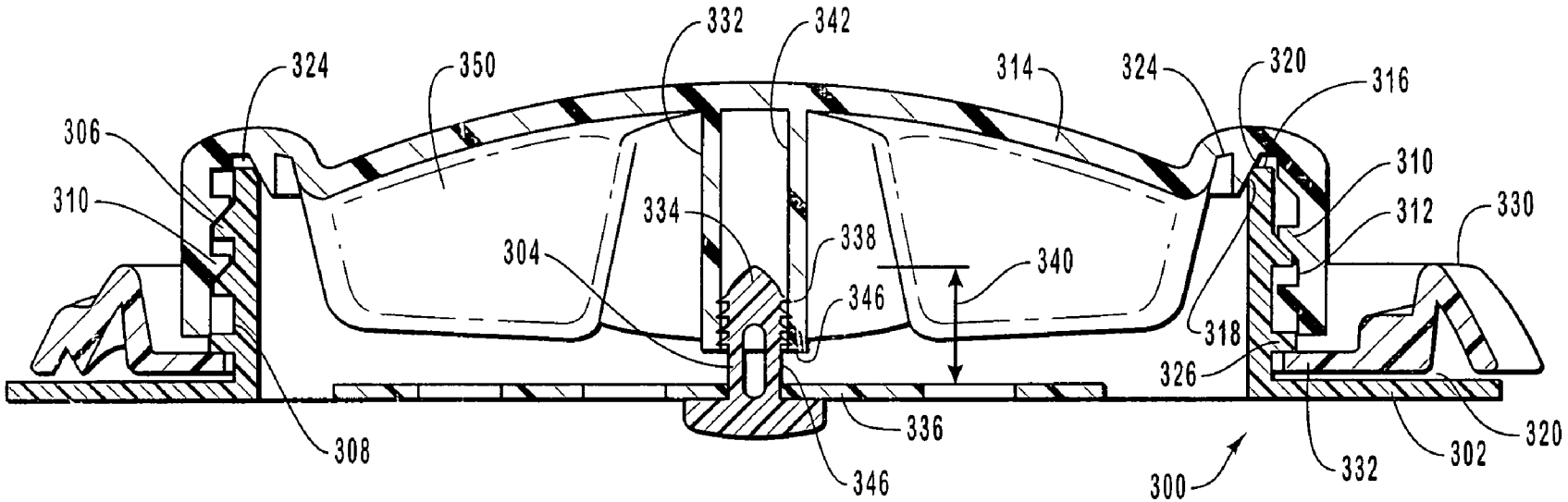
FIG. 13 is an cross sectional view of an alternate inlet assembly and cap of the invention.
Figure 14:
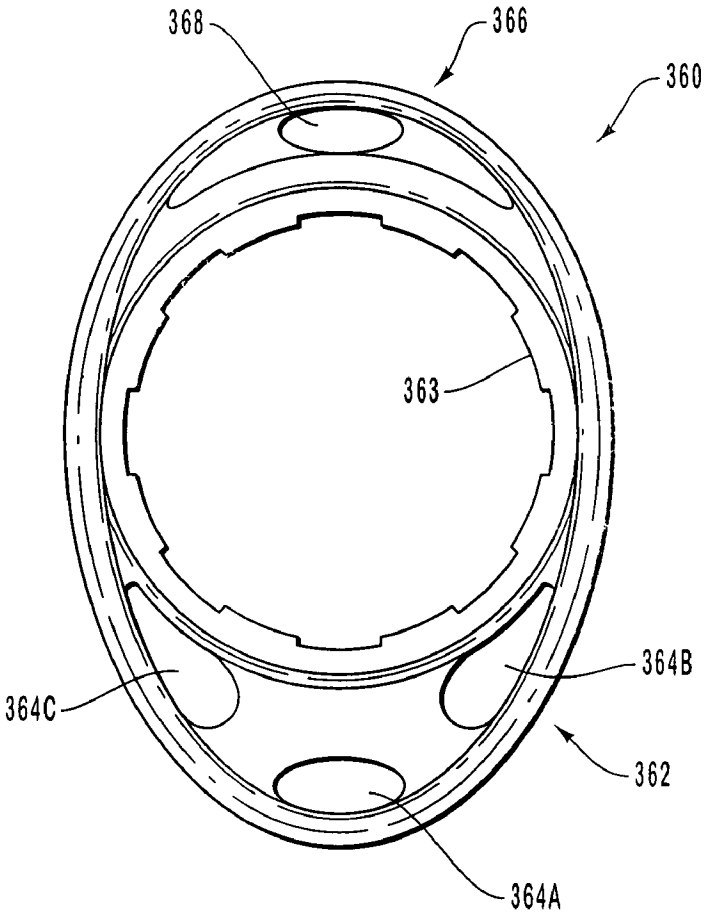
FIG. 14 is a top view of an handle structure for use with the alternate inlet assembly and cap of FIG. 13.

FIG. 14 shows a handle 360 with a handle portion 362 and a locking ring 363. The handle portion 362 is here shown to have a plurality of apertures 364A, 364B and 364C which function as finger holds and as stiffeners. A second handle 364 has a handle portion 366 shown generally opposite to the handle portion 362. It also has a aperture 368 which functions as a finger hold and as a stiffener. The locking ring 364 has a plurality of teeth formed to engage the flange of a neck of an inlet assembly like flange 326 (FIG. 13).

Those skilled in the art will understand that the above embodiments illustrate the principals of the invention and are not intended to limit the scope of the claims which themselves recite those features deemed to be essential to the invention.

I claim:

1. A container comprising:

wall means for defining a volume to contain matter;

a mouth positioned in said wall means for passing matter into and out of said volume;

a cap sized to fit on said mouth and positionable between a closed position in which said cap is positioned on said mouth to inhibit the movement of said matter into and out of said volume and an open position in which said cap is removed from said mouth for the movement of matter therethrough;

a tether having a first end and second end with a stretch therein between, said first end being secured to one of said wall means and said mouth and a second end secured to said cap, said tether being movable between a stored position in which said tether is positioned substantially within said mouth and a deployed position in which said tether extends from one of said mouth and said wall means to said cap in its open position, said stretch being formed to be a selected geometric shape in said stored condition and formed of a material having a memory urging said stretch toward said stored position.

2. The container of claim 1, wherein said mouth has a base attached to said wall means and a neck attached to said base to extend away from said base and exterior of said wall means.

3. The container of claim 2, further including attachment means for removably and sealably associating said cap with said mouth when said cap is positioned in said closed position.

4. The container of claim 3 wherein said attachment means includes first threads formed on said neck and second threads formed with said cap for threadedly engaging said first threads.

5. The container of claim 2, wherein said first end of said tether is formed unitarily with said mouth.

6. The container of claim 5, wherein said cap has a mount, and wherein said tether is attached to said mount.

7. The container of claim 6, wherein said cap has an interior surface, and wherein said mount is centrally attached to said interior surface.

8. The container of claim 7 wherein said base of said mouth has a rim that is substantially planar and defines a rim plane, wherein said tether is attached to proximate said rim of said base of said mouth, wherein said mount has a height selected to position said second end of said tether proximate said rim plane with said cap in said closed position.

9. The container of claim 8, wherein said stretch of said tether in said stored position extends spirally at least 360 degrees about said mount to said second end.

10. The container of claim 9 wherein said stretch of said tether in said stored position extends spirally at least 540 degrees about said mount to said second end.

11. The container of claim 1 wherein said tether in said open position has an effective length sized for positioning said cap away from said mouth a distance selected for user access to said mouth.

12. The container of claim 8 wherein a rivet having a post and a head attaches said tether to said mount, wherein said second end of said tether has an aperture sized to receive said post of said rivet there through to rotate there about.

13. The container of claim 12 wherein said tether has a thickness and a width, and wherein said width is at least twice that of the thickness.

14. The container of claim 13 wherein said tether is made of flexible plastic.

15. The container of claim 14 wherein said tether is made polythene.

16. The container of claim 13, wherein said width is between about 0.5 cm and 1.0 cm, said length is between about 20 cm and 30 cm, and said thickness is between about 0.1 and 0.3 cm.

17. The container of claim 13, wherein said neck defines an aperture through said mouth which neck is cylindrical in shape with a diameter from about 5 centimeters to about 15 centimeters.

18. The container of claim 1, wherein the wall means is unitarily formed to have a bottom and at least one wall and with a top configured to contain said mouth.

19. The container of claim 1, wherein the wall means is a formed of a least one flexible sidewall having an upper edge sealed to form a first seal and a lower edge sealed to from a second seal.

20. The container of claim 19 further including a discharge port sealingly positioned in said second seal.

21. The container of claim 20 wherein said discharge port has a first base with a first aperture formed therein for communicating liquid between said volume and exterior of said container.

22. The container of claim 21 wherein said wall is formed to have two opposite edges extending between said upper edge and said lower edge.

23. The container of claim 22 wherein said lower seal has a portion extending at an angle from said lower edge toward one of said two opposite edges.

24. The container of claim 23 wherein said base of said discharge port has a first outer surface and a second outer surface spaced from said first outer surface with said first aperture positioned thereinbetween, said first outer surface and said second outer surface each configured to be sealed into said lower seal.

25. The container of claim 24 wherein said first base has a first edge and a second edge with said aperture therein-between and with said first outer surface and said second outer surface extending arcuately between said first edge and said second edge.

26. The container of claim 20 further including a discharge tube connectable to said discharge port.

27. The container of claim 26 wherein said discharge port includes a valve operable between an open position and a closed position.

28. The container of claim 27 wherein said valve is a bayonet valve and wherein said discharge tube has a bayoneted connector insertable into said valve to operate said bayonet valve from a normally closed position to an open position.

29. The container of claim 28 wherein said bayonet valve has an axis essentially normal to said lower seal, and wherein said bayonet has a housing which includes an elbow extending away from said axis.

30. The container of claim 21 further including a bite valve operable between a closed position to pass liquid therethrough and a closed position inhibiting the flow of liquid there through by the user biting thereon, said bite valve being positioned on the distal end of said discharge tube, said discharge tube being sized in length to extend to the user's mouth.

31. The container of claim 1 further including a thermal control chamber positioned proximate said wall means and attached thereto.

32. The container of claim 31 wherein said thermal control chamber includes a substance that is thermally treated to place it at a temperature different from ambient temperature.

33. The container of claim 32 wherein said thermal control chamber is at least two separate sealed chambers.

34. The container of claim 33 wherein said wall means includes a wall member, and wherein said thermal control chamber is formed by said wall member and a thermal chamber wall sealed to said wall member to define said thermal chamber therein between.

35. The container of claim 1 further including a handle removably attached to said mouth, said handle being sized for grasping by the user's hand.

36. The container of claim 35 wherein said handle includes apertures sized and shaped for positioning on suspension structure for suspending said container therefrom.

37. The container of claim 35 wherein said end for connection with said cap is rotatably connected to said cap.

38. The container of claim 11 wherein said end for connection with said cap is rotatably connected to said cap.

39. The container of claim 14 wherein said tether is formed from polyurethane.

40. The container of claim 1 wherein said selected geometric shape is a spiral.

41. The container of claim 2 wherein said cap has a cap sealing surface and said neck has a neck sealing surface to abut said cap sealing surface with said cap in said closed position.

42. The container of claim 1 wherein said second end of said tether is removably secured to said cap.

43. The container of claim 6 where said tether is attached to said mount by a rivet.

44. The container of claim 6 wherein said tether is attached to said mount by a removable rivet.

45. A portable container system comprising:

wall means for defining a volume to contain matter;

a mouth positioned in said wall for passing matter into and out of said volume, said mouth having an aperture sized to allow movement of matter into and out of the volume;

a cap sized to fit on the mouth positionable between a closed position in which the cap is sealed on the mouth to inhibit the movement of matter out of said volume and an open position in which the cap is removed from the mouth for the passage of matter into and out of said volume, said cap having a mount formed thereon to extend into said mouth with said cap in said closed position;

a tether with a first end attached to said mouth and a second end attached to said mount of said cap with a stretch in between, said tether being movable from a stored position with said cap in said closed position to a deployed position with said cap in said open position, said stretch being spiral in shape to extend radially about said mount at least 360 degrees in said stored position, said stretch having a thickness and a width and formed of a plastic material which urges said tether to said stored position from said deployed position;

a discharge port attached to said wall means for transporting matter from within to without of said volume;

a discharge tube removably connected to said discharge port for transporting matter from said discharge port; and a bite valve positioned on the distal end of said discharge tube for operation by the user between an open position for passage of matter therefrom and a closed position inhibiting the flow of matter therefrom.

* * * * *